United States Patent [19]

Johnson

[11] Patent Number: 4,557,427

[45] Date of Patent: Dec. 10, 1985

[54] POWERED STRAP ACCUMULATOR

[75] Inventor: Robert A. Johnson, Flossmoor, Ill.

[73] Assignee: Interlake, Inc., Oak Brook, Ill.

[21] Appl. No.: 660,696

[22] Filed: Oct. 15, 1984

[51] Int. Cl.[4] ..... B65H 16/00

[52] U.S. Cl. ..... 242/55; 242/105

[58] Field of Search ..... 242/54 R, 78.6, 78.7, 242/105, 75.1, 75.43; 226/118

[56] References Cited

U.S. PATENT DOCUMENTS

| | | | |
|---|---|---|---|
| 1,929,568 | 10/1933 | Spowart | 242/105 |
| 2,844,334 | 7/1958 | Luth | 242/128 |
| 3,058,689 | 10/1962 | Luth | 242/128 |
| 3,544,029 | 12/1970 | Meier | 242/78.6 |
| 3,602,452 | 8/1971 | Saver | 242/75.43 |
| 3,952,961 | 4/1976 | Antepenko | 242/54 R |

OTHER PUBLICATIONS

Interlake Technical Publication Form TP-34 for D11A0 and D11B0, Jan. 1983.

*Primary Examiner*—Leonard D. Christian

*Attorney, Agent, or Firm*—Emrich & Dithmar

[57] ABSTRACT

A strap accumulator for use between strapping apparatus and apparatus for dispensing strap from the outside of a mill-wound supply reel, includes a coil holder for accommodating a ribbon-wound coil of dispensed strap. The outer diameter of the coil is constrained by an expandable spring steel hoop biased to a contracted condition. Motor-driven feed wheels feed strap from the supply reel through a gap in the hoop to the outside of the coil along the inner surface of the hoop. The coil is laterally retained by side structure having an aperture permitting withdrawal of strap from the center of the coil. The natural expansion of the coil holds the hoop expanded for opening a switch to deenergize the feed motor. Withdrawal of strap from the coil contracts it, allowing the hoop to contract for closing the switch and energizing the feed motor to feed more strap to the coil. Safety switch means are provided to deenergize the strapping apparatus in the event of malfunction of the accumulator. The accumulator may be free standing or commonly mounted with the strap dispensing apparatus.

20 Claims, 6 Drawing Figures

POWERED STRAP ACCUMULATOR

BACKGROUND OF THE INVENTION

The present invention relates to systems for dispensing strap from a coil and, in particular to a strap accumulator for such dispensing systems. While the invention may be used with any type of strap, it has particular application to plastic strapping.

Strap for binding packages, boxes, bundles, coils of wire, and the like, is supplied from the finishing mill in coils described as "mill wound" and ribbon wound". A mill-wound coil is one having a thickness greater than the strap width, usually three to six times as thick, and wherein the strap convolutions crisscross so that strap is evenly distributed throughout the coil. A ribbon-wound coil has a thickness equal to the width of the strap, and each convolution exactly overlies the next.

Many coils tend to be quite heavy and have considerable inertia. Accordingly, when strap is unwound from such a coil for use by a strapping machine or the like, the inertia tends to produce considerable shock on the strap feeding mechanism of the associated strapping machine. This is particularly true of mill-wound coils which are typically heavier than ribbon-wound coils of comparable diameter. Thus, in the start-stop mode of operation of a typical strapping machine, considerable energy must be expended to repeatedly restart the rotation of the coil for unreeling thereof, and this energy must repeatedly be dissipated by braking mechanisms or the like to avoid overrun of the coil and resultant tangling of the strap.

In order to alleviate these problems, it is known to use strap accumulating devices between the coil dispensing mechanism and the associated strapping machine. In such accumulating devices the strap is unreeled from the outside of the supply reel and is fed loosely into the accumulator, which accumulates a supply of the strap. The strapping machine withdraws strap from the accumulator at high speed with virtually no resistance. A separate power feed wheel draws strap from the supply reel to replenish the accumulator, usually at a slower rate. One such accumulator which is widely used with plastic strap is in the form of a narrow box having a width only slightly greater than the width of the strap. The strap is pushed into one side of the box and it piles up inside the box, being continually folded back upon itself in random fashion, the strap being withdrawn from the other side of the box.

A disadvantage of this random type of accumulation, particularly in the case of plastic strap, is that the strap forms fairly tight curves at the folds. This results in random curl in the strapping material, particularly if it is left in its folded condition for a protracted time, such as overnight. This random curl can result in malfunctioning of the strapping machine upon start up. Furthermore, in such box-type accumulators, there is a large amount of wasted space and the ratio of accumulated strap length to accumulator volume is relatively low.

SUMMARY OF THE INVENTION

It is a general object of this invention to provide an improved strap accumulator which avoids the disadvantages of prior accumulators while affording additional structural and operating advantages.

An important object of the invention is the provision of a strap accumulator which is particularly advantageous when the strap can be withdrawn only from the outer periphery of an associated supply coil.

It is another object of the invention to provide a strap accumulator of the type set forth which avoids the setting of random curl in the accumulated strap.

In connection with the foregoing object it is another object of the invention to provide a strap accumulator of the type set forth which accumulates strap in a regular and non-random fashion.

Another object of the invention is the provision of a strap accumulator which efficiently stores the accumulated strap.

These and other objects of the invention are attained by providing a strap accumulator for use in accumulating strap dispensed from the outside of a mill-wound supply reel so that the accumulated strap can be withdrawn to associated strapping equipment with minimal resistance, the accumulator comprising: coil holding means on which a ribbon-wound coil of dispensed strap may be formed, feed means for receiving strap dispensed from the supply reel and feeding it to the outside of the coil on the coil holding means, the coil holding means accommodating withdrawal of the accumulated strap from the center of the coil, and control means coupled to the coil holding means and responsive to the withdrawal of strap from the coil for controlling the operation of the feed means.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
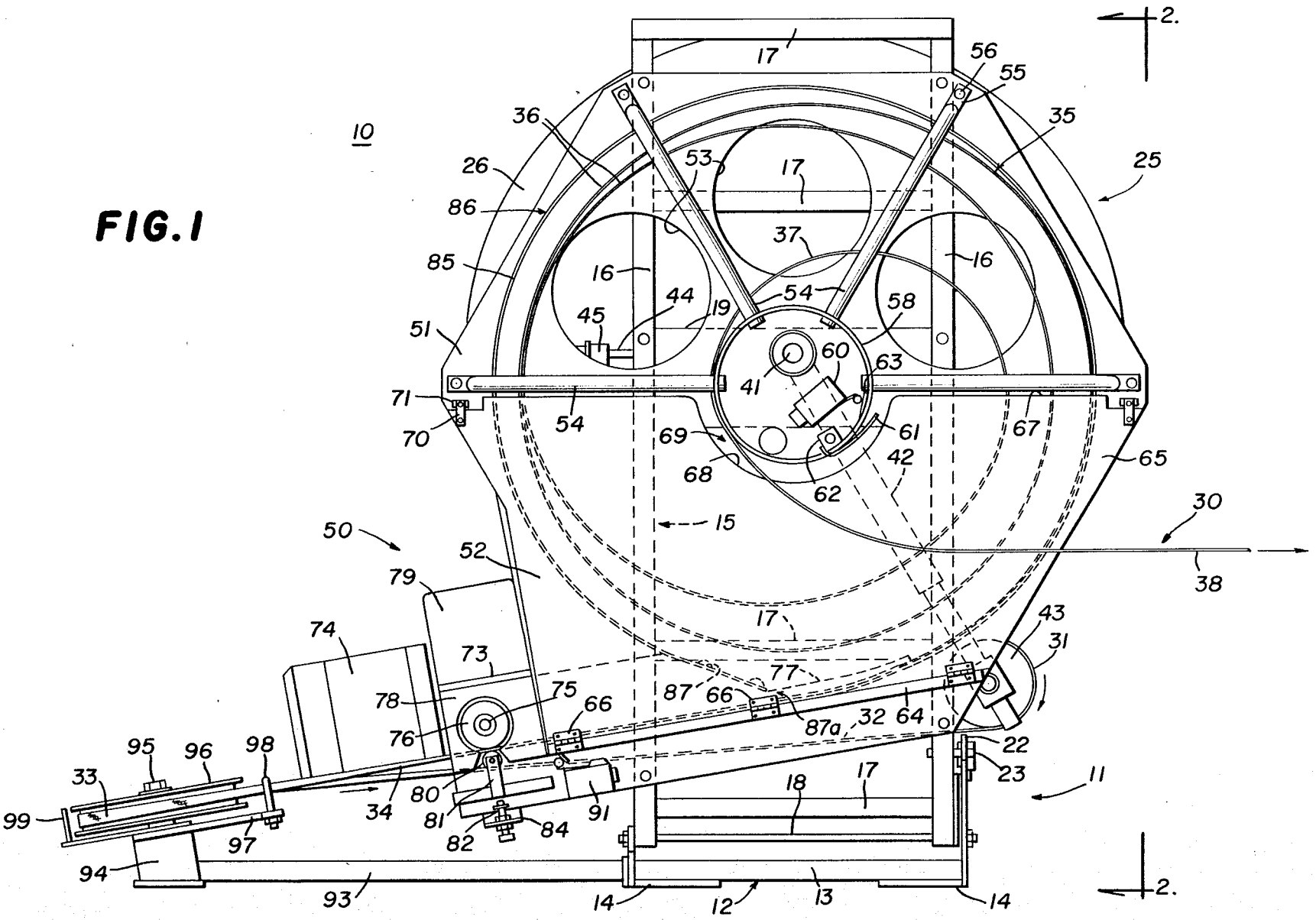
FIG. 1 is a side elevational view of a strap dispensing system including a strap accumulator constructed in accordance with and embodying the features of the present invention.
Figure 2:
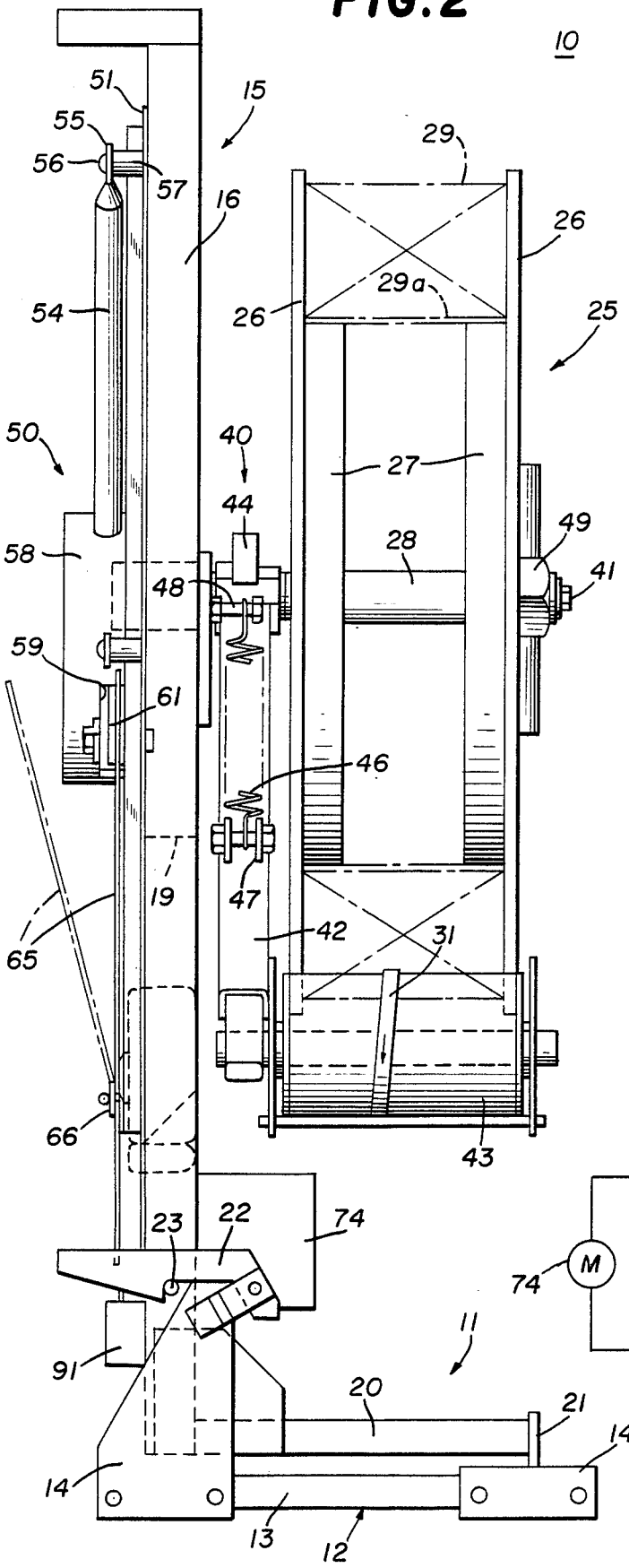
FIG. 2 is an end elevational view of the dispensing system of FIG. 1, as viewed from the right-hand end thereof, and illustrating different positions of the accumulator cover plate.

Referring to FIGS. 1 and 2, there is illustrated a dispensing system, generally designated by the numeral 10, for dispensing strap 30 from an associated supply reel 25. The strap 30 is typically plastic strapping, but it may also be metal strapping. The dispensing system 10 includes a dispenser mechanism 40 for unreeling the strap 30 from the supply reel 25 and an accumulator 50, constructed in accordance with and embodying the features of the present invention. The dispenser mechanism 40 and the accumulator 50 are mounted on a common support assembly 11, which typically forms a part of the dispenser mechanism 40. However, it will be appreciated that the accumulator 50 could be freestanding so as to be usable with any type of dispenser mechanism. The dispenser mechanism 40 and its associated support assembly 11 illustrated in the drawings are of the type sold by the Acme Packaging Division of Interlake, Inc. under the Model No. D11B0 and, accordingly, only so much of the structure thereof as is necessary for an understanding of the present invention will be described in detail herein.

The support assembly 11 includes a rectangular base 12 comprising four tubular members 13, each preferably rectangular in transverse cross section, and interconnected by angle plates 14. Carried by the base 12 is an elongated mounting frame 15 which includes a pair of parallel elongated posts 16 interconnected by a plurality of spaced-apart parallel cross bars 17. The mounting frame 15 is pivotally mounted on the base 12, as by a pivot shaft 18, for pivotal movement between an erected position, illustrated in the drawings, and a folded position (not shown), pivoted counterclockwise, as viewed in FIG. 2, to a position substantially parallel with the base 12 to facilitate handling and transportation. A rectangular support plate 19 also interconnects the posts 16 intermediate the ends thereof.

Fixedly secured to the mounting frame 15 at its lower end and extending rearwardly therefrom, substantially perpendicular thereto, is an elongated brace leg 20 (FIG. 2), provided at its distal end with a foot 21, adapted for engagement with the ground or other underlying support surface when the mounting frame 15 is disposed in its erected position to stabilize it in that position and limit pivotal movement thereof. A latch plate 22 is pivotally mounted on one of the angle plates 14 for engagement with a keeper pin 23 on the mounting frame 15 for locking the mounting frame 15 in its erected position.

The supply reel 25 is of conventional construction, including a pair of circular side plates 26, each having a cylindrical support flange 27 integral therewith and projecting laterally inwardly therefrom. The side plates 26 are interconnected by a cylindrical hub 28. The support flanges 27 have a diameter substantially less than the outer diameter of the side plates 26, the support flanges 27 cooperating to define a support for receiving an associated coil 29 of the strap 30. More specifically, the coil 29 is provided with a cylindrical coil plate **29*a* which spans and rests upon the support flanges 27, the strap 30 being mill wound on the coil plate 29*a* to form the coil 29. As the strap 30 is dispensed from the coil 29 and is fed to the accumulator 50 and thence to an associated strapping machine, it forms a number of reaches 31–38**, which will be explained in greater detail below.

The dispenser mechanism 40 includes an axle 41 which is fixedly secured to the support plate 19 and projects rearwardly therefrom substantially perpendicular thereto. It will be appreciated that the axle 41 is received through the cylindrical hub 28 for rotatably mounting the reel 25. Also pivotally mounted on the axle 41 for rotation about the axis thereof is an elongated dancer arm 42 which projects radially downwardly from the axle 41, the dancer arm 42 being provided at its distal end with a rotatably mounted roller 43 having the axis of rotation thereof disposed substantially parallel to the axle 41. In use, the roller 43 lies along the outer periphery of the supply reel 25 when it is mounted on the axle 41. Coupled to the dancer arm 42 is a brake linkage 44, only a portion of which is shown, coupled at its distal end with a brake shoe 45 disposed for frictional engagement with the exposed surface of the support flange 27 on the adjacent one of the reel side plates 26. A helical tension spring 46 extends between a bracket 47 on the dancer arm 42 and a stud 48 carried by the support plate 19 for resiliently biasing the dancer arm 42 toward rotation in a counterclockwise direction, as viewed in FIG. 1, for holding the brake shoe 45 in frictional braking engagement with the support flange 27. A wing nut 49 secures the supply reel 25 in place on the axle 41.

In operation, a dispensing reach 31 of the strap 30 is withdrawn from the outside of the coil 29 at the bottom of the reel 25 to the right, as viewed in FIG. 1, and is then fed over and around the roller 43 into a return reach 32 which extends back in the opposite direction, to the left, as viewed in FIG. 1. In unreeling the strap 30 from the supply reel 25, the return reach 32 is pulled to the left, as viewed in FIG. 1, thereby rotating the dancer arm 42 in a clockwise direction, as viewed in FIG. 1, against the urging of the bias spring 46. This movement of the dancer arm 42 disengages the brake shoe 45 from the support flange 27, permitting free rotation of the supply reel 25. When the withdrawing force on the return reach 32 of the strap 30 is released, the dancer arm 42 returns to its normal position under the urging of the bias spring 46, thereby braking the supply reel 25 and stopping the rotation thereof to prevent overrun and the dispensing of excess strap.

Figure 5:
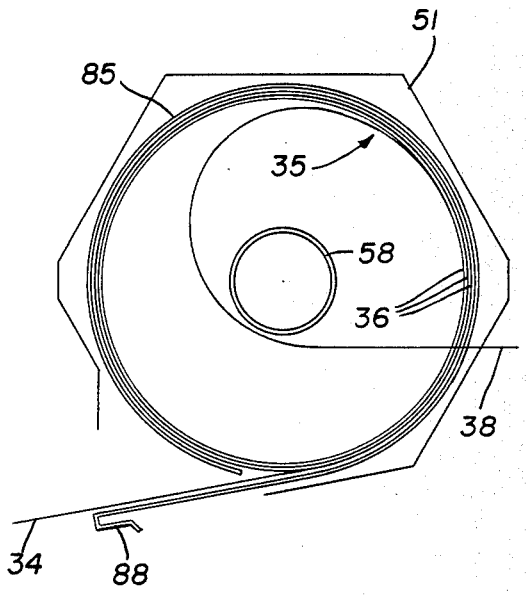
FIG. 5 is a reduced, diagrammatic view of the accumulator of FIG. 1, illustrated in its filled and atrest condition.
Figure 3:
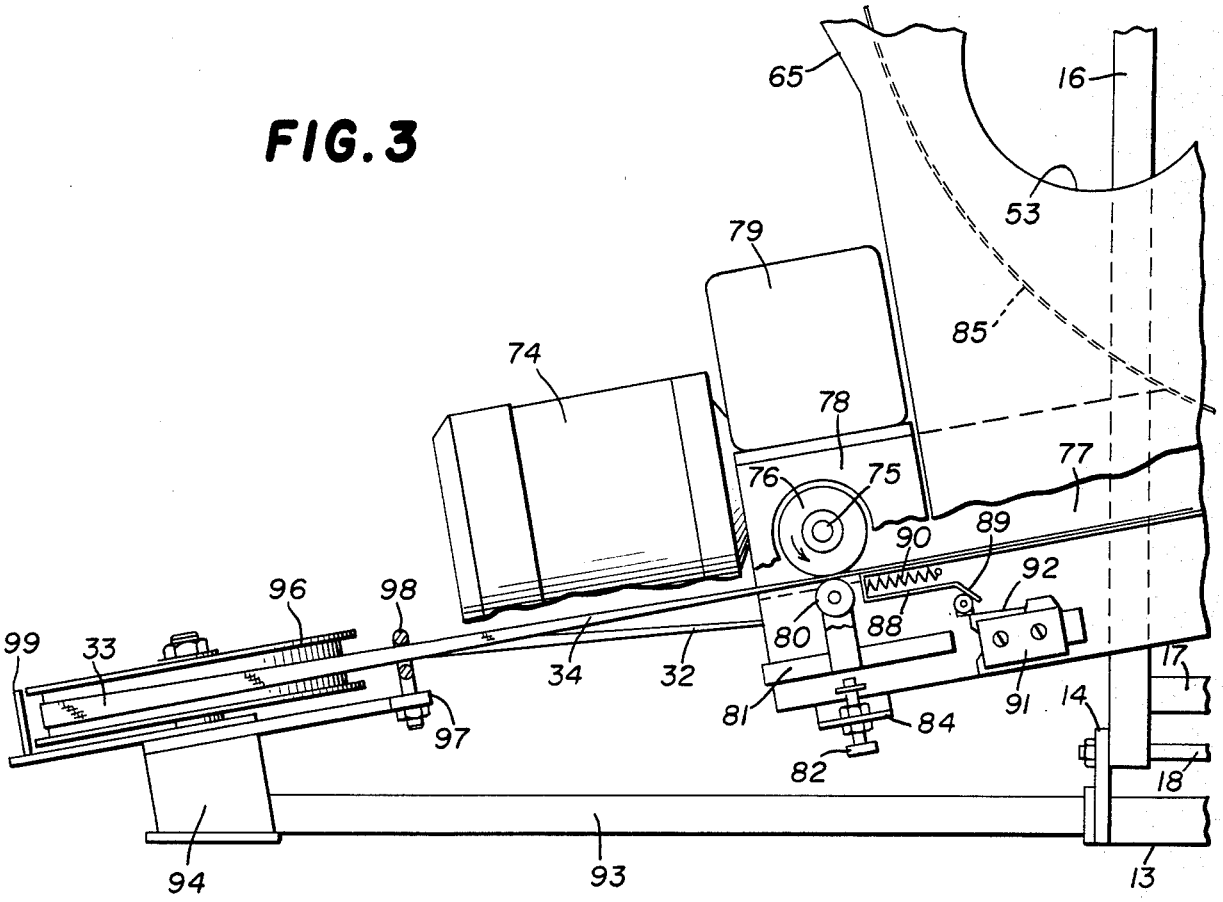
FIG. 3 is an enlarged, fragmentary view of the left-hand portion of FIG. 1, with parts broken away more clearly to illustrate the construction.
Figure 4:
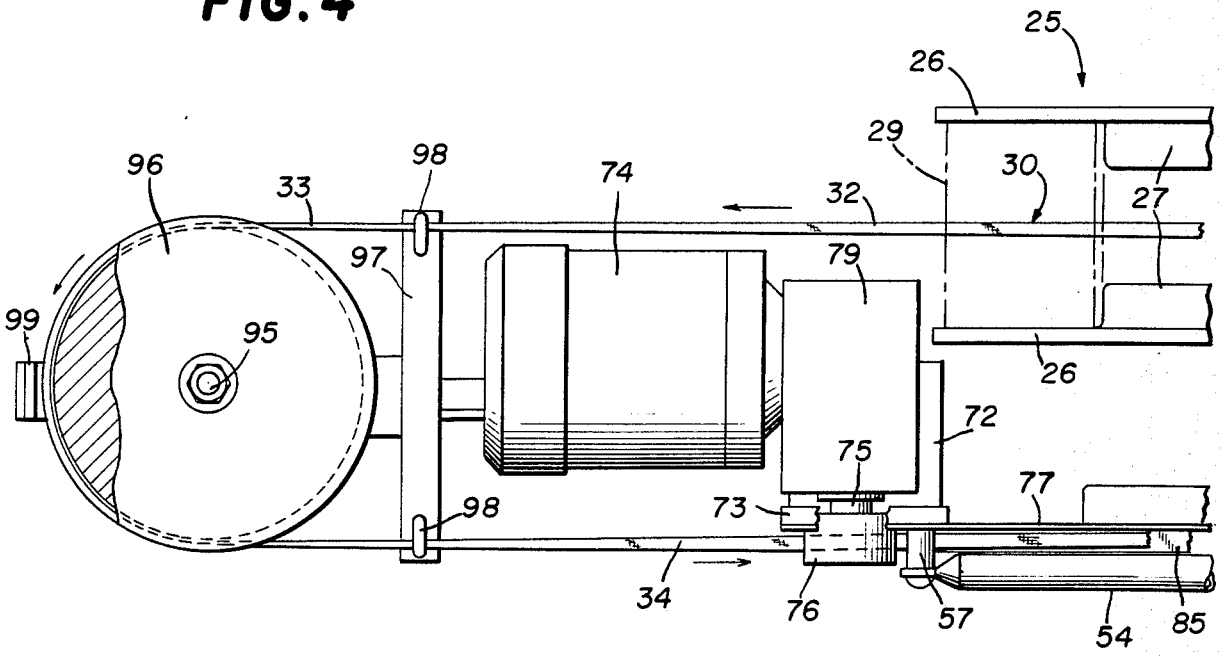
FIG. 4 is a fragmentary, top plan view of the portion of the accumulator illustrated in FIG. 3.

Referring now also to FIGS. 3–5, the accumulator 50 includes a flat, generally hexagonal side plate 51 which is fixedly secured to the mounting frame 15 parallel thereto by suitable fasteners. The side plate 51 is provided at its lower end with an irregular spur portion 52, and is also provided with a plurality of lightening holes 53 (three shown) for weight reduction. Fixedly secured to the front surface of the side plate 51 and disposed substantially parallel thereto are four equiangularly spaced-apart elongated retaining arms 54, each having a flattened end 55 which is secured by a suitable fastener 56 to the side plate 51. The fasteners 56 are received through tubular spacers 57 to space the retaining arms 54 from the side plate 51 a distance slightly greater than the width of the strap 30 (see FIG. 2). The inner ends of the retaining arms 54 extend through complementary openings in and are fixedly secured to a cylindrical hub 58, which is secured to the side plate 51 centrally thereof and projects forwardly therefrom. Preferably, the retaining arms 54 are disposed radially of the hub 58, with two of the retaining arms 54 extending substantially horizontally diametrically of the hub 58.

The hub 58 is provided with an arcuate notch 59 therein adjacent to the side plate 51 (see FIG. 2). Mounted on the side plate 51 within the hub 58 and adjacent to the notch 59 is a normally closed limit switch 60. An arcuate, elongated actuator lever 61 is pivotally mounted on a pivot block 62 carried by the hub 58 adjacent to one end of the notch 59, the actuator lever 61 being adapted in use to span the notch 59. Fixedly secured to the actuator lever 61 and extending inwardly therefrom is a finger 63 which projects through the notch 59 and is disposed for engagement with the contact arm of the switch 60 for actuation thereof. The finger 63 has a length such that it overlaps the inner surface of the hub 58, the actuator lever 61 being normally pivoted by gravity in a clockwise direction, as viewed in FIG. 1, with the finger 63 engaging the hub 58 to limit this pivotal movement of the actuator lever 61 and retain it in place.

The lower edge of the side plate 51 is inclined to the horizontal when the mounting frame 15 is erected. Fixedly secured to the side plate 51 substantially parallel to its lower edge is an elongated support bar 64. A flat cover plate 65 is hingedly mounted on the support bar 64 by a plurality of hinges 66 for movement between a closed position, disposed substantially parallel to the side plate 51 and spaced forwardly therefrom a distance slightly greater than the width of the strap 30, as illustrated in solid line in the drawings, and an open position, illustrated in broken line in FIG. 2, providing access to the interior of the accumulator 50. The cover plate 65 may be provided with lightening holes (not shown) like the holes 53 in the side plate 51. The cover plate 65 is adapted to cover only the lower half of the side plate 51. More specifically, the cover plate 65 has an upper edge 67 which is disposed in use closely adjacent to and substantially parallel to the horizontal ones of the retaining arms 54 when the cover plate 65 is disposed in its closed position. The upper edge 67 has a central arcuate portion 68 which is coaxial with the hub 58 and spaced radially outwardly a slight distance therefrom for cooperation therewith to define a withdrawal aperture 69, for a purpose to be explained below. The cover plate 65 is provided adjacent to its upper edge 67 with a pair of latches 70 adapted for cooperation with keepers 71 on the side plate 51 for holding the cover plate 65 in its closed position.

Fixedly secured to the spur portion 52 of the side plate 51 and projecting rearwardly therefrom substantially perpendicular thereto is a mounting plate 72 (FIG. 4), which is disposed beneath and parallel to a rearwardly extending flange 73 on the spur portion 52. Mounted on the mounting plate 72 is a right angle gearmotor 74, which has an output shaft 75 projecting through a complementary aperture in the spur portion 52 of the side plate 51. The gearmotor 74 may be of the type sold by Bodine Electric Company under the Model No. 48R-5N. Fixedly mounted on the shaft 75 is a feed wheel 76. An elongated strap guide 77 is mounted on the side plate 51 and extends generally parallel to the bottom edge thereof. A guide plate 78 is secured to the front surface of the strap guide 77 in surrounding relationship with the feed wheel 76. Overlying the gearmotor 74 and secured thereto is an electrical connector box 79.

An idler wheel 80 is carried by a mounting arm 81 supported on the spur portion 52 of the side plate 51, the idler wheel 80 being disposed for cooperation with the feed wheel 76 for frictionally gripping the strap 30 therebetween to effect feeding thereof in the direction of the arrow in FIG. 1. An adjustment mechanism 82 is coupled to the arm 81 and is supported on a bracket 84 for controlling the resilient frictional force with which the idler wheel 80 is held against the feed wheel 76.

An elongated flexible band 85, preferably formed of spring steel, is disposed along the front surface of the side plate 51. More specifically, the band 85 is disposed with its width dimension disposed substantially perpendicular to the side plate 51, this width being such that the band 85 can fit freely between the side plate 51 and the overlying retaining arms 54 and cover plate 65. The band 85 is curved to form a generally cylindrical hoop 86, with one end 87 of the band 85 being fixedly secured to the side plate 51. The distal end of the band 85 overlaps the fixed end 87 and extends outwardly generally tangent to the hoop 86 and is spaced a predetermined slight distance from the fixed end 87 for cooperation therewith to define a gap **87*a* (FIG. 1) in the hoop 86. The distal end of the hoop 86 has a recurved flange 88 thereon provided with an outturned lip 89 (FIG. 3). It can be seen that the hoop 86 is generally coaxial with the hub 58 and cooperates therewith to define therebetween an annular space having a width slightly greater than that of the strap 30, for accumulating therein a predetermined length of the strap 30**, as will be explained more fully below.

Figure 6:
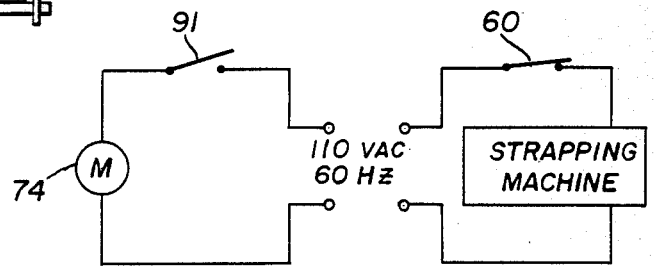
FIG. 6 is a schematic diagram of the control circuit of the present invention.

The distal end of the band 85 extends along the upper edge of the support bar 64 and is movable back and forth therealong. It will be appreciated that the hoop 86 has a natural tendency to expand outwardly toward the flattened ends of the retaining arms 54 to a normal expanded condition (see FIG. 5). However, there is mounted on the side plate 51 and disposed within the recurved flange 88 of the band 85 a helical compression spring 90, which resiliently urges the distal end of the band 85 to the left, as viewed in FIG. 3, to overcome the natural expansion tendency of the hoop 86 and urge it to a predetermined contracted condition. In this predetermined contracted condition, the lip 89 engages the contact arm 92 of a normally-open limit switch 91, mounted on the side plate 51, for closing the switch 91. When the hoop 86 is in its expanded condition, the lip 89 is moved to the right from the position shown in FIG. 3 and out of contact with the contact arm 92 for allowing the switch 91 to close. Referring to FIG. 6, it can be seen that the switch 91 is connected in series between the gearmotor 74 and an associated source of 60 Hz, 110 VAC power. Thus, when the hoop 86 is in its normal expanded condition, illustrated in FIG. 5, the gearmotor 74 is deenergized, while when the hoop 86 is in its contracted condition, illustrated in FIGS. 1 and 3, the gearmotor 74 is energized.

Fixedly secured to the rectangular base 12 and projecting therefrom parallel thereto is a base extension 93, carrying at its distal end an upstanding bracket 94. Mounted on the bracket 94 is a shaft 95 on which is rotatably mounted an idler wheel 96. Extending from the bracket 94 beneath the idler wheel 96 and parallel thereto is an arm 97 carrying thereon two spaced-apart, upstanding guide eyes 98. Also mounted on the bracket 94 and extending upwardly across the outer periphery of the idler wheel 96 is a retainer 99.

Referring in particular to FIGS. 1, 3 and 4, it can be seen that in use the return reach 32 of the strap 30 extends from the roller 43 through one of the guide eyes 98. As it passes through the guide eye 98, the strap 30 is twisted one-quarter turn to form a turn-around reach 33 which extends around the idler wheel 96 in the direction of the arrows in FIG. 4. The strap 30 then extends through the other one of the guide eyes 98, being then twisted back one-quarter turn to form a feed reach 34 which extends between the feed wheel 76 and the idler wheel 80. The feed reach 34 then extends between the free distal end of the band 85 and the lower edge of the strap guide 77 and is guided up along the inner surface of the distal end of the band 85 and through the gap **87*a*** in the hoop 86 to form a ribbon-wound coil 35 along the inner surface of the hoop 86.

Referring in particular to FIGS. 1 and 5, as the strap 30 is fed along the hoop 86, it continues to spiral inwardly to form a predetermined number of convolutions 36 of the coil 35, it being appreciated that the strap 30 has a natural tendency to expand the coil 35 outwardly against the hoop 86 so that all of the convolutions 36 will lie tightly against one another. When a predetermined number of convolutions 36 has been built up in the ribbon-wound coil 35, the inner convolution 37 is fed laterally out through the withdrawal aperture 69 to form a withdrawal reach 38 which extends to the associated strapping machine or other equipment.

It will be appreciated that the side plate 51, the retaining arms 54, the hub 58, the cover plate 65 and the hoop 86 cooperate to form a holder for the coil 35. More specifically, the hoop 86 and the hub 58 circumferentially retain the coil 35, while the side plate 51 cooperates with the retaining arms 54 and the cover plate 65 to laterally retain the coil 35. The fact that the space between these lateral retaining elements is only slightly greater than the width of the strap 30 insures that the coil 35 will be built up in a ribbonwound fashion with the convolutions 36 directly overlying one another. When the predetermined number of convolutions 36 have been built up on the coil 35, the coil 35 will be disposed in a rest condition, illustrated in FIG. 5, with a maximum length of strap 30 being accumulated in the coil 35. The expansion of the coil 35 against the hoop 86 cooperates with the natural expansion tendency of the hoop 86 to overcome the force of the bias spring 90 and moves the hoop 86 to its expanded condition, pulling the distal end of the band 85 to the right, as viewed in FIG. 3, thereby opening the switch 91 and deenergizing the gearmotor 74.

When the strapping machine requires strap, it pulls the withdrawal reach 38 in the direction of the arrow in FIG. 1. This movement tends to contract the convolutions 36 of the coil 35 radially inwardly, as illustrated in FIG. 1, without changing the number of the convolutions. This contraction of the coil 35 pulls it away from the hoop 86, allowing the hoop 86 to move back to its contracted condition under the urging of the bias spring 90, thereby reclosing the switch 91 for energizing the gearmotor 74. Thus, the feed wheel 76 is operated to pull more strap from the supply reel 25 and feed it into the accumulator coil 35. As strap is fed into the coil 35, its convolutions 36 tend to expand. When the coil 35 is expanded sufficiently to push the hoop 86 back to its expanded condition, the gearmotor 74 is deenergized for terminating the strap feed.

It will be appreciated that the strap 30 is withdrawn from the coil 35 with negligible resistance. The length of accumulated strap 30 in the coil 35 which is available for use by the strapping machine is the difference in strap length between the fully expanded and fully contracted conditions of the coil 35. Thus, it will be appreciated that the coil 35 can never be exhausted, so that there is always strap in the accumulator 50.

However, in the event of malfunction in the accumulator 50 or the dispenser mechanism 40, it may be possible that the strapping machine will withdraw all the available strap from the coil 35, completely contracting the coil 35 onto the hub 58. In this event, as the coil 35 begins to tighten on the hub 58, it moves the actuator lever 61 inwardly for opening the switch 60. The switch 60 is connected in series with the associated strapping machine so that its opening deenergizes the strapping machine, terminating the withdrawal of strap from the coil 35.

It is a significant feature of the present invention that in the preferred embodiment the coil 35, in its normal expanded rest position, has a diameter at least approximately the same as that of supply reel 25. Thus, no tight loops can remain in the coil 35 for any length of time, thereby effectively preventing the introduction of random curl in the strap 30. However, it will be appreciated that the accumulator 50 is not limited to that diameter and could be made of any size desired. The ribbon-wound coil 35 permits an orderly accumulation of the strap 30 and permits it to be withdrawn from the accumulated supply without tangling or snarling. Furthermore, the natural tendency of the coil 35 to expand maximizes the length of coil that can be accumulated in a given space. Finally, the safety switch 60 effectively prevents excess drag from ever being felt by the associated strapping machine.

From the foregoing, it can be seen that there has been provided an improved strap accumulator which is of relatively simple and economical construction, affords efficient accumulation of strap without introducing random curl therein and effectively prevents exhaustion of the accumulated length of strap.

I claim:

1. A strap accumulator for use in accumulating strap dispensed from the outside of a supply reel so that the accumulated strap can be withdrawn to associated strapping equipment with minimal resistance, said accumulator comprising: coil holding means on which a ribbon-wound coil of dispensed strap may be formed, feed means for receiving strap dispensed from the outside of the supply reel and feeding it to the outside of said coil on said coil holding means, said coil holding means accommodating withdrawal of the accumulated strap from the center of said coil, and control means coupled to said coil holding means and responsive to the withdrawal of strap from said coil for controlling the operation of said feed means.

2. The strap accumulator of claim 1, wherein said coil has a natural tendency to expand, said coil holding means including means circumferentially retaining said ribbon-wound coil and limiting expansion thereof.

3. The strap accumulator of claim 2, wherein said coil holding means includes means laterally retaining said coil.

4. The strap accumulator of claim 1, wherein said ribbon-wound coil includes a predetermined number of convolutions.

5. The strap accumulator of claim 1, wherein said control means has a normal rest condition deactuating said feed means when a predetermined length of strap is accumulated in said coil, said control means being responsive to withdrawal of strap from said coil for actuating said feed means.

6. The strap accumulator of claim 1, wherein said feed means includes means for directing the strap into said coil in substantially the same direction in which it leaves the supply reel.

7. A strap accumulator for use in accumulating strap dispensed from the outside of a supply reel so that the accumulated strap can be withdrawn to associated strapping equipment with minimal resistance, said accumulator comprising: a flexible expandable hoop having an inner surface on which a ribbon-wound coil of dispensed strap may be formed, bias means resiliently urging said hoop to a contracted condition, said ribbonwound coil naturally tending to expand against said inner surface for moving said hoop to an expanded condition against the urging of said bias means, said hoop having an opening therein, feed means for receiving strap dispensed from the supply reel and feeding it through said opening to the outside of said coil along said inner surface of said hoop, retaining means cooperating with said hoop to retain said coil thereon and accommodating withdrawal of the accumulated strap from the center of said coil, withdrawal of strap from the center of said coil causing contraction thereof away from said hoop and permitting movement of said hoop to its contracted condition by said bias means, and control means coupled to said hoop and responsive to movement thereof between the expanded and contracted conditions thereof for controlling the operation of said feed means.

8. The strap accumulator of claim 7, wherein said hoop is formed of an elongated band of spring metal.

9. The strap accumulator of claim 8, wherein one end of said band is fixed, the other end of said band being movable with respect to said fixed end in directions generally tangent to said hoop.

10. The strap accumulator of claim 7, wherein said feed means includes an electric motor.

11. The strap accumulator of claim 10, wherein said control means includes switch means electrically connected between said motor and an associated source of electric power, said switch means being mechanically coupled to said hoop.

12. The strap accumulator of claim 11, wherein the feeding of additional strap into said coil causes expansion thereof to move said hoop toward its expanded condition, said switch means being responsive to movement of said hoop to its expanded condition for deactuating said feed means, said switch being responsive to movement of said hoop to its contracted condition for actuating said feed means.

13. The strap accumulator of claim 12, wherein a first predetermined contraction of said coil permits movement of said hoop to its contracted condition, said control means further including second normally closed switch means connected in circuit with the associated strapping equipment, said second switch means being responsive to a second predetermined contraction of said coil greater than said first predetermined contraction for opening to deactuate the associated strapping equipment.

14. The strap accumulator of claim 7, wherein said hoop is oriented with the axis thereof substantially parallel to the axis of the associated supply reel.

15. The strap accumulator of claim 7, and further including hub means disposed centrally of said hoop substantially coaxially therewith for limiting the contraction of said coil.

16. A strap accumulator for use in accumulating strap dispensed from the outside of a supply reel so that the accumulated strap can be withdrawn to associated strapping equipment with minimal resistance, said accumulator comprising: a frame, an elongated longitudinally flexible flat band curved to form an expandable hoop having an inner surface on which a ribbonwound coil of dispensed strap may be formed, one end of said band being fixed to said frame and the other end thereof being movable with respect to said frame, bias means coupled to said movable end of said band for urging it toward a contracted condition of said hoop, said ribbonwound coil naturally tending to expand against said inner surface for moving said hoop to an expanded condition against the urging of said bias means, said fixed end of said band being spaced from the movable end of said band to form an opening in said hoop, feed means for receiving strap dispensed from the supply reel and feeding it through said opening to the outside of said coil along said inner surface of said hoop, a cylindrical hub carried by said frame inside and substantially coaxially with said hoop and cooperating therewith to accommodate said coil therebetween, retaining means on said frame cooperating with said hub and said hoop to retain said coil therebetween and to define an aperture through which the accumulated strap can be withdrawn from the center of said coil, withdrawal of strap from the center of said coil causing contraction thereof away from said hoop and permitting movement of said movable end of said band by said bias means to move said hoop to its contracted condition, and control means coupled to said movable end of said band and responsive to movement thereof between the expanded and contracted conditions of said hoop for controlling the operation of said feed means.

17. The strap accumulator of claim 16, wherein said feed means includes guide means for changing the direction and orientation of the strap as it is fed from the supply reel to said coil.

18. The strap accumulator of claim 16, wherein said frame includes means for supporting thereon the associated supply reel and dispensing mechanism therefor.

19. The strap accumulator of claim 16, wherein said feed means includes an electric motor, said control means including a limit switch coupled to said movable end of said band and connected in circuit with said motor, said switch being responsive to movement of said hoop to its contracted condition for actuating said feed means and being responsive to movement of said hoop to its expanded condition for deactuating said feed means.

20. The strap accumulator of claim 19, wherein said control means further includes a second normally closed switch connected in circuit with the associated strapping equipment, said hub having a movable portion engageable with said auxiliary switch, said movable portion being movable by said coil upon contraction thereof into contact with said hub around the entire circumference thereof for opening said second switch to deactuate the associated strapping equipment.

* * * * *